United States Patent [19]

Gagnon et al.

[11] Patent Number: 5,072,850

[45] Date of Patent: Dec. 17, 1991

[54] RECEPTACLE FOR FOODSTUFFS AND THE LIKE

[76] Inventors: Robert M. Gagnon, 107 Chestnut Hill Rd, Ridgefield, Conn. 06877; Daniel Carpenter, Box 6A, R.D. 1, Newport, N.Y. 13146

[21] Appl. No.: 691,380

[22] Filed: Apr. 25, 1991

[51] Int. Cl.[5] ..... B65D 41/06; B65D 21/02

[52] U.S. Cl. ..... 220/300; 220/293; 215/332

[58] Field of Search ..... 220/297, 300, 293, 380, 220/908; 215/332, 356, 357; 206/505, 506, 509, 515, 519

[56] References Cited

U.S. PATENT DOCUMENTS

| | | | |
|---|---|---|---|
| 81,296 | 8/1868 | Rohrbacher et al. | 215/357 |
| 697,371 | 4/1902 | Sindorf | 215/332 |
| 788,495 | 4/1905 | Sawin | 215/357 X |
| 1,216,869 | 2/1917 | Snigo | 220/300 X |
| 1,351,964 | 9/1920 | Orofino | 220/300 |
| 2,679,878 | 6/1954 | Stine | 150/48 |
| 2,805,795 | 9/1957 | Barnes | 220/300 X |
| 3,312,336 | 4/1967 | Fally | 220/300 X |
| 3,854,582 | 12/1974 | Martinelli | 220/300 X |
| 4,279,355 | 7/1981 | Schwartz et al. | 220/300 |
| 4,334,630 | 6/1982 | Bergin | 220/300 |
| 4,473,170 | 9/1984 | Ciancimino | 220/300 |
| 4,723,686 | 2/1988 | Pennisi | 200/300 |
| 4,961,514 | 10/1990 | Palmer | 220/293 X |

FOREIGN PATENT DOCUMENTS 1058230 5/1959 Fed. Rep. of Germany ..... 220/297

*Primary Examiner*—Stephen Marcus
*Assistant Examiner*—Vanessa Caretto
*Attorney, Agent, or Firm*—Peter K. Kontler

[57] ABSTRACT

A trash can wherein the open top of the container is surrounded by a ring-shaped rim having two inwardly extending prongs forming part of a bayonet mount. The lid of the can has a top portion and a depending annular skirt which can be inserted into the rim preparatory to activation of the bayonet mount which further comprises two inverted L-shaped slots in the external surface of the skirt. The lower ends of the slots are open to permit entry of prongs in response to placing of the lid onto the rim, and the lid is then turned relative to the container in order to cause the prongs to enter the substantially horizontal portions of the respective slots. The bayonet mount ensures that the lid cannot be separated from the container by dogs, bears, raccoons and/or other animals. In addition, the bayonet mount can maintain the top portion of the lid in substantial sealing engagement with the rim to prevent the escape of odors and/or flowable substances. The slots are disposed at the ends of a substantially diametrically extending grip at the upper side of the top portion of the lid to thus facilitate proper orientation of the lid prior to its connection to the container.

16 Claims, 1 Drawing Sheet

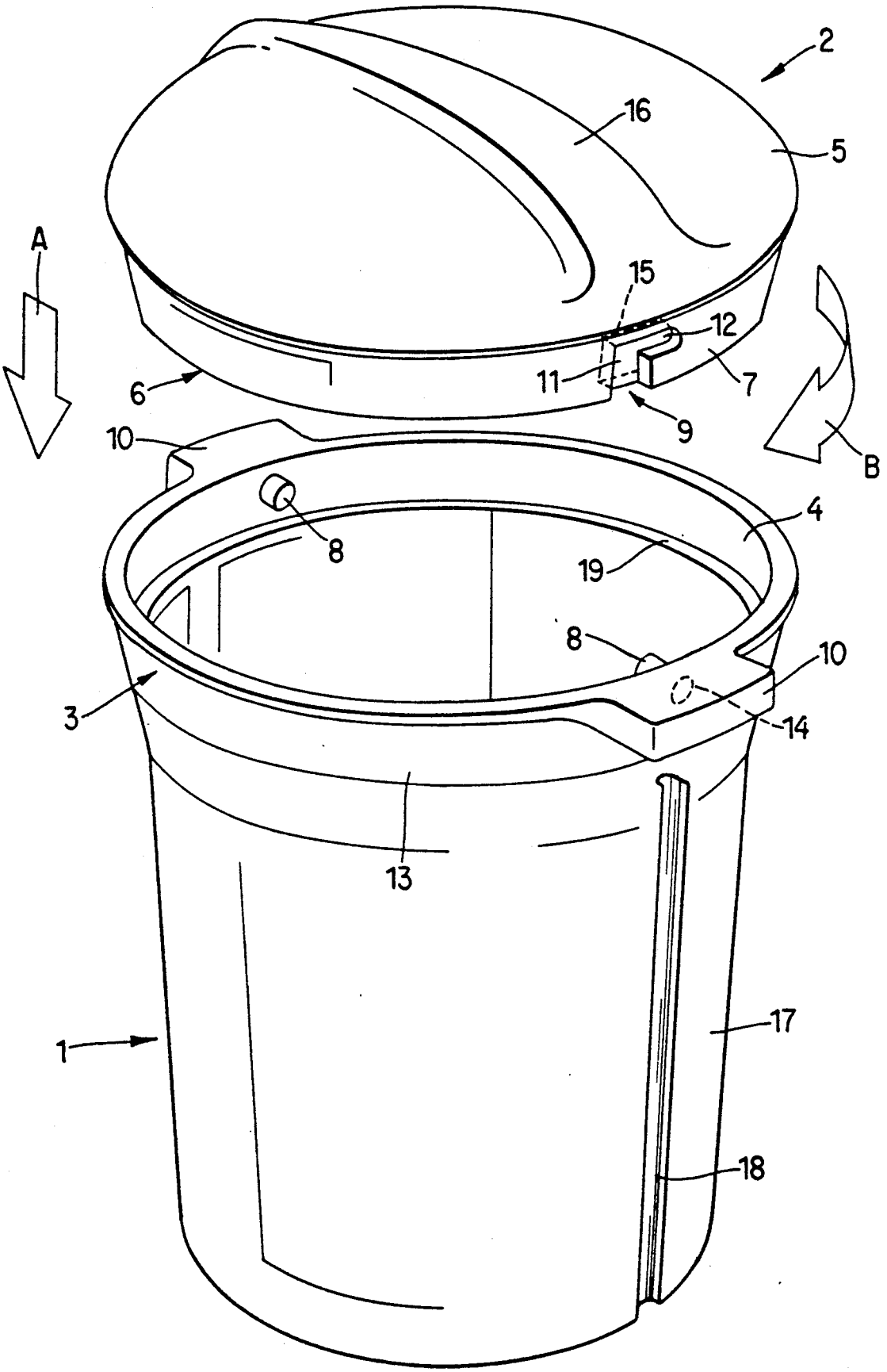
2
16
5
A
15
12
11
7
6
9
10
B
4
8
19
8
10
3
14
13
17
1
18

RECEPTACLE FOR FOODSTUFFS AND THE LIKE

BACKGROUND OF THE INVENTION

The invention relates to improvements in receptacles for fresh or decomposed foodstuffs and other flowable or particulate materials, especially for use as trash cans or garbage cans. More particularly, the invention relates to improvements in receptacles of the type wherein the cover or lid can be separably connected to the container by a bayonet mount.

Garbage cans or trash cans with lids which can be separably connected to the containers for garbage or other materials are disclosed in U.S. Pat. No. 2,679,878 to Stine, in U.S. Pat. No. 4,473,170 to Ciancimino, and in U.S. Pat. No. 4,723,686 to Pennisi. A drawback of the patented cans is that they cannot be mass produced at a reasonable cost, that the locking action between the container and the lid is not reliable, that the operator of the can cannot rapidly ascertain that orientation of the lid which is necessary to ensure that the lid can be separably secured to the container and/or that the attachment of the lid to or its detachment from the container necessitates the exertion of a substantial force which is undesirable when the can is to be manipulated by a female operator, by an adolescent, by a senior citizen or by a convalescent.

OBJECTS OF THE INVENTION

An object of the invention is to provide a receptacle for foodstuffs and the like, particularly a receptacle which can be used with advantage as a garbage can or trash can, which is constructed and which can be manipulated in such a way that its contents cannot be readily spilled or rendered accessible in response to upsetting by wild or domestic animals.

Another object of the invention is to provide a receptacle where in the cover or lid can be separably but securely connected to the container for foodstuffs and/or other materials in such a way that even the flowable contents can remain confined in the receptacle upon tilting or overturning and that the receptacle can prevent the escape of noxious odors.

A further object of the invention is to provide a receptacle which can be mass produced at a reasonable cost by resorting to available production techniques.

An additional object of the invention is to provide the receptacle with a lid which can be properly oriented for convenient attachment to the container.

Still another object of the invention is to provide a novel and improved container and a novel and improved lid for use in the above outlined receptacle.

A further object of the invention is to provide a highly sanitary receptacle, particularly a trash can, which safely confines its contents against access by rodents and/or insects irrespective of whether the receptacle is upright or lies on the ground.

SUMMARY OF THE INVENTION

The invention is embodied in a receptacle for decayed and/or undecayed foodstuffs, trash and the like. The improved receptacle can be utilized with advantage as a trash can or garbage can and comprises a container having an open top and a substantially ring-shaped rim with an internal surface which surrounds the open top, and a lid having a top portion and an annular skirt which depends from the top portion and is receivable in the rim; at such time, an external surface of the skirt is adjacent the internal surface of the rim. The receptacle further comprises a bayonet mount which serves to separably connect and to lock the skirt to the rim. The bayonet mount comprises a plurality of bayonets or prongs which extend from the internal surface of the rim, and slots which are provided in the external surface of the skirt and each of which receives one of the prongs when the skirt is received in the rim.

The container of the improved receptacle preferably comprises two handles which are outwardly adjacent the rim and are disposed substantially diametrically opposite each other. The prongs preferably include a first prong which is adjacent one of the handles and a second prong which is adjacent the other handle.

Each slot of the bayonet mount comprises a first section having an open lower end, and a second section which communicates with and extends substantially at right angles to the first section in the circumferential direction of the skirt. The latter has additional surfaces which surround the second sections of the slots and cooperate with the prongs to preferably urge the top portion of the lid (such top portion extends radially outwardly beyond the skirt) against the rim when each prong of the bayonet mount is received in the second section of a discrete slot. The external surfaces of the prongs are or can be in rather pronounced frictional engagement with the additional surfaces surrounding the second sections of the respective slots when the top portion of the lid is urged against the rim.

The external surface of the rim can be provided with sockets each of which extends into one of the prongs, i.e., the prongs can constitute inwardly extending portions of the material of the rim. Analogously, the internal surface of the skirt can be provided with protuberances which are complementary to the slots, and each slot extends into one of these protuberances.

The outer side or top side of the top portion of the lid can be provided with an elongated grip which extends substantially diametrically of the skirt. The slots of such skirt preferably include a first slot and a second slot, and the grip comprises first and second end portions which are respectively adjacent the first and second slots.

The height (i.e., the axial length) of the skirt can be in the range of between 1½ and 5 inches.

The container includes a main body portion beneath the rim, and such main body portion can be provided with elongated external grooves, one for each prong of the bayonet mount. The distribution of the grooves is such that each of these grooves can receive a prong at the internal surface of the rim of an identical second container when the main body portion is inserted into the second container. This facilitates the stacking of a number of identical containers to occupy a minimum amount of space in storage or during shipment.

The open lower ends of the first sections of slots in the external surface of the skirt are distributed in such a way that the skirt is insertable into the rim only when each open lower end is aligned with and is ready to receive one of the prongs.

The container can be provided with an internal annular stop (e.g., in the form of a shoulder) which is at least closely adjacent the skirt when the latter is received and locked in the rim.

The novel features which are considered as characteristic of the invention are set forth in particular in the appended claims. The improved receptacle itself, however, both as to its construction and the mode of manipulating the same, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a perspective view of a receptacle which embodies one form of the invention, the lid of the receptacle being shown in a position above the rim of the container and the bayonet mount of the illustrated receptacle having two prongs and inverted L-shaped slots for the prongs.

DESCRIPTION OF THE PREFERRED EMBODIMENTS

The receptacle which is shown in the drawing comprises an open-top container 1 and a separable or detachable closure or lid 2. The open top of the container 1 is surrounded by a ring-shaped rim 3 having a substantially cylindrical internal surface 4 with two coaxial bayonets or prongs 8 which can constitute relatively short cylinders or truncated cones (e.g., cylinders with an axial length of ½" to 1") and confront each other across the open top. The lid 2 comprises a preferably concave-convex top portion 5 and a circumferentially complete annular skirt 6 which depends from the underside of the top portion and can be inserted into the rim 3 in two predetermined angular positions of the lid 2 relative to the container 1 or vice versa. The container 1 can be of standard [e.g., 28-gallon or 32-gallon) size.

The external surface 7 of the skirt 6 is formed with two inverted L-shaped grooves or slots 9 (one of which is shown in the drawing) each of which comprises a substantially vertical (axially parallel) first section 11 with an open lower end, and a second section 12 which communicates with the upper end of the respective first section 11 and extends substantially at right angles thereto in the circumferential direction of the skirt. The open lower ends of the first sections 11 are provided in the bottom face of edge face of the skirt 6. The slots 9 are disposed diametrically opposite each other so that their first sections 11 can receive the adjacent prongs 8 in the illustrated angular positions of the container 1 and lid 2 relative to each other or when the lid or the container is turned through 180 degrees from the illustrated position. The arrow A indicates the direction of downward movement of the lid 2 in order to ensure that the prongs 8 can enter the vertical first sections 11 of the respective slots 9, and the lid is then turned in the direction of arrow B in order to ensure that each prong 8 enters the circumferentially extending second section 12 of the respective slot. The peripheral surfaces of the prongs 8 can be caused to frictionally engage the surfaces around the slot sections 12 with any desired force which suffices to prevent unintentional separation of the lid 2 from the container 1. Such unintentional separation should be prevented when the receptacle is overturned by a domestic or wild animal in search of food.

The inclination and the dimensions of the surfaces bounding the second sections 12 of the slots 9 are preferably selected in such a way that the properly inserted prongs 8 cause the underside of the overhanging radially outermost part of the top portion 5 of the lid 2 to bear against the rim 3 when the bayonet mount including the two prongs 8 and the two slots 9 has been caused to reliably but separably connect the lid to the container 1. This merely involves proper dimensioning of the slots 9 and proper selection of the distance of the second sections 12 from the underside of the top portion 5.

The container 1 is provided with two simple handles 10 which are outwardly adjacent and are integral with the rim 3. Each of these handles is adjacent one of the prongs 8; this ensures that the user can readily locate the prongs 8 even if they are concealed by a bag which is inserted into the container 1 in such a way that its open end overlies and extends outwardly beyond the rim 3. For the same reason, the slots 9 are preferably adjacent the ends of an elongated grip 16 at the outer or upper side of the top portion 5 of the lid 2. Thus, the operator of the improved receptacle has several possibilities to properly orient the lid 2 prior to movement of the lid in the direction of arrow A for the purpose of causing penetration of each prong 8 into one of the slots 9 before the lid is turned in the direction of arrow B.

The improved receptacle can be mass produced in available plants and is preferably made of a suitable plastic material. However, the making of the receptacle from metallic sheet material by stamping or by resorting to a similar technique is not excluded. The character 14 denotes one of two sockets which are formed in the external surface 13 of the rim 3 as a result of the making of prongs 8. Each socket 14 extends into one of the prongs 8. The character 15 denotes one of two substantially L-shaped protuberances at the inner side of the skirt 6; each of the slots 9 extends into one of the protuberances 15.

In order to facilitate stacking of the illustrated container 1 with one or more additional containers of identical design, the external surface of the main body portion 17 of the container 1 is provided with two elongated external grooves 18 (one shown) each of which can receive one prong 8 of a second container (not shown) which is inserted into the illustrated container. Such stacking of two or more containers ensures that the space requirements of a large number of containers for the purpose of storage or transport are surprisingly small.

The container 1 is formed with an internal annular shoulder 19 which can serve as an abutment or stop for the lower end face or edge face of the skirt 6 when the prongs 8 are received in the sections 12 of the respective slots 9. This can establish an additional or an alternative sealing engagement between the lid 2 and the container 1 in order to prevent the escape of noxious odors and/or the escape of flowable (even liquid) contents of the receptacle.

An important advantage of the improved receptacle is its simplicity. Furthermore, the receptacle can be mass produced at a low cost and is capable of resisting the activities of dogs and certain nocturnal wild animals, particularly bears and raccoons. In addition, the lid 2 can be caused to sealingly engage the rim at one, two or three locations (namely along the surfaces 4 and 7, between the rim 3 and the top portion 5, and between the skirt 6 and the shoulder 19) to confine odors and flowable liquid or solid contents irrespective of whether the receptacle is maintained in an upright position or is caused or happens to lie on the ground.

The improved receptacle can be modified in a number of ways without departing from the spirit of the invention. For example, the bayonet mount can comprise a single prong 8 and a single slot 9, a single prong 8 and two or more slots 9, or three or more preferably equidistant prongs and an identical number of slots. Furthermore, the upper side of the top portion 5 of the lid 2 can bear information, e.g., arrows or representations of prongs, to further facilitate rapid and accurate orientation of the lid 2 relative to the container 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A receptacle for foodstuffs, trash and the like, comprising a container having an open top and including a substantially ring-shaped rim having an internal surface surrounding said open top, and two handles which are outwardly adjacent said rim and are located substantially diametrically opposite each other; a lid having a top portion and an annular skirt depending from said top portion and receivable in said rim, said skirt having an external surface which is adjacent said internal surface when said skirt is received in said rim; and a bayonet mount for separably connecting said skirt to said rim when the skirt is received in said rim, said bayonet mount comprising a plurality of prongs extending from said internal surface and slots provided in said external surface and each receiving one of said prongs when said skirt is received in said rim, said prongs including a first prong adjacent one of said handles and a second prong adjacent the other of said handles.

2. The receptacle of claim 1, wherein each of said slots includes a first section having an open lower end and a second section communicating with and extending substantially at right angles to the first section in the circumferential direction of said skirt.

3. The receptacle of claim 1, wherein said skirt has an internal surface with protuberances substantially complementary to said slots, each of said slots extending into a discrete protuberance of said skirt.

4. The receptacle of claim 1, wherein said top portion has an outer side and an elongated grip provided at said outer side and extending substantially diametrically of said skirt, said slots including a first slot and a second slot and said grip having first and second end portions which are respectively adjacent said first and second slots.

5. The receptacle of claim 1, wherein said skirt has a height in the range of 1½ to 5 inches.

6. The receptacle of claim 1, wherein said container includes a main body portion beneath said rim and said main body portion has elongated external grooves, one for each of said prongs, the distribution of said grooves being such that each thereof receives a prong at the internal surface of the rim of a second container when said main body portion is inserted into such second container.

7. The receptacle of claim 1, wherein said slots have open lower ends and said skirt is receivable in said rim only when each of said open lower ends is aligned with and is ready to receive one of said prongs.

8. The receptacle of claim 1, wherein said container has an internal annular stop which is at least closely adjacent said skirt when the skirt is received and locked in said rim.

9. A receptacle for foodstuffs, trash and the like, comprising a container having an open top and including a substantially ring-shaped rim having an internal surface surrounding said open top; a lid having a top portion and an annular skirt depending from said top portion and receivable in said rim, said skirt having an external surface which is adjacent said internal surface when said skirt is received in said rim; and a bayonet mount for separably connecting said skirt to said rim when the skirt is received in the rim, said bayonet mount comprising a plurality of prongs extending from said internal surface and slots provided in said external surface and each receiving one of said prongs when said skirt is received in said rim, said rim having an external surface with sockets extending into said prongs.

10. The receptacle of claim 9, wherein said container comprises two handles which are outwardly adjacent said rim and are located substantially diametrically opposite each other, said prongs including a first prong adjacent one of said handles and a second prong adjacent the other of said handles.

11. A receptacle for foodstuffs, trash and the like, comprising a container having an open top and including a substantially ring-shaped rim having an internal surface surrounding said open top; a lid having a top portion and an annular skirt depending from said top portion and receivable in said rim, said skirt having an external surface which is adjacent said internal surface when said skirt is received in said rim; and a bayonet mount for separably connecting said skirt to said rim when the skirt is received in the rim, said bayonet mount comprising a plurality of prongs extending from said internal surface and slots provided in said external surface and each receiving one of said prongs when said skirt is received in said rim, said skirt having an internal surface with protuberances substantially complementary to said slots, each of said slots extending into a discrete protuberance of said skirt.

12. A receptacle for foodstuffs, trash and the like, comprising a container having an open top and including a substantially ring-shaped rim having an internal surface surrounding said open top; a lid having a top portion and an annular skirt depending from said top portion and receivable in said rim, said skirt having an external surface which is adjacent said internal surface when said skirt is received in said rim; and a bayonet mount for separably connecting said skirt to said rim when the skirt is received in the rim, said bayonet mount comprising a plurality of prongs extending from said internal surface and slots provided in said external surface and each receiving one of said prongs when said skirt is received in said rim, said top portion having an outer side and an elongated grip provided at said outer side and extending substantially diametrically of said skirt, said slots including a first slot and a second slot and said grip having first and second end portions which are respectively adjacent said first and second slots.

13. A receptacle for foodstuffs, trash and the like, comprising a container having an open top and including a substantially ring-shaped rim having an internal surface surrounding said open top; a lid having a top portion and an annular skirt depending from said top portion and receivable in said rim, said skirt having an external surface which is adjacent said internal surface when said skirt is received in said rim; and a bayonet mount for separably connecting said skirt to said rim when the skirt is received in the rim, said bayonet mount comprising a plurality of prongs extending from said internal surface and slots provided in said external surface and each receiving one of said prongs when said skirt is received in said rim, said container including a main body portion beneath said rim and said main body portion having elongated external grooves, one for each of said prongs, the distribution of said grooves being such that each thereof receives a prong at the internal surface of the rim of a second container when said main body portion is inserted into such second container.

14. A receptacle for foodstuffs, trash and the like, comprising a container having an open top and including a substantially ring-shaped rim having an internal surface surrounding said open top; a lid having a top portion and an annular skirt depending from said top portion and receivable in said rim, said skirt having an external surface which is adjacent said internal surface when said skirt is received in said rim; and a bayonet mount for separably connecting said skirt to said rim when the skirt is received in the rim, said bayonet mount comprising a plurality o prongs extending from said internal surface and slots provided in said external surface and each receiving one of said prongs when said skirt is received in said rim, said container having an internal annular stop which is at least closely adjacent said skirt when the skirt is received and locked in said rim.

15. A receptacle for foodstuffs, trash and the like, comprising a container having an open top and including a substantially ring-shaped rim having an internal surface surrounding said open top, and two handles which are outwardly adjacent said rim and are located substantially diametrically opposite each other; a lid having a top portion and an annular skirt depending from said top portion and receivable in said rim, said skirt having an external surface which is adjacent said internal surface when said skirt is received in said rim; and a bayonet mount for separably connecting said skirt to said rim when the skirt is received in the rim, said bayonet mount comprising a male portion having a plurality of components in the from of prongs extending from one of said surfaces, and a female portion including a plurality of components in the form of slots provided in the other of said surfaces, each of said slots receiving one of said prongs when said skirt is received in said rim, the components of one of said male and female portions including a first component adjacent one of said handles and a second component adjacent the other of said handles.

16. A receptacle for foodstuffs, trash and the like, comprising a container having an open top and including a substantially ring-shaped rim having an internal surface surrounding said open top; a lid having a top portion and an annular skirt depending from said top portion and receivable in said rim, said skirt having an external surface which is adjacent said internal surface when said skirt is received in said rim; and a bayonet mount for separably connecting said skirt to said rim when the skirt is received in the rim, said bayonet mount comprising a male portion having a plurality of components in the form of prongs extending from one of said surfaces, and a female portion including a plurality of components in the form of slots provided in the other of said surfaces, said top portion having an outer side and an elongated grip provided at said outer side and extending substantially diametrically of said skirt, the components of one of said male and female portions including a first component and a second component and said grip having first and second end portions which are respectively adjacent said first and second components.

* * * * *